US009966002B2

(12) United States Patent
Xiang et al.

(10) Patent No.: US 9,966,002 B2
(45) Date of Patent: May 8, 2018

(54) DISPLAY PANEL AND DISPLAY PANEL COMPENSATION METHOD

(71) Applicants: Shanghai Tianma AM-OLED Co., Ltd., Shanghai (CN); Tianma Micro-electronics Co., Ltd., Shenzhen (CN)

(72) Inventors: Dongxu Xiang, Shanghai (CN); Yue Li, Shanghai (CN); Dong Qian, Shanghai (CN); Renyuan Zhu, Shanghai (CN); Tong Wu, Shanghai (CN); Gang Liu, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 30 days.

(21) Appl. No.: 15/348,214

(22) Filed: Nov. 10, 2016

(65) Prior Publication Data

US 2017/0061871 A1 Mar. 2, 2017

(30) Foreign Application Priority Data

Aug. 18, 2016 (CN) ..... 2016-10685210

(51) Int. Cl.
*G09G 3/30* (2006.01)
*G09G 3/3208* (2016.01)
(Continued)

(52) U.S. Cl.
CPC ..... *G09G 3/3208* (2013.01); *G09G 3/006* (2013.01); *G09G 3/2014* (2013.01); *G09G 2320/0209* (2013.01)

(58) Field of Classification Search
CPC ..... G09G 3/3208
(Continued)

(56) References Cited

U.S. PATENT DOCUMENTS

2003/0122759 A1* 7/2003 Abe ..... G09G 3/22 345/89
2006/0022914 A1* 2/2006 Kimura ..... G09G 3/2014 345/76
(Continued)

FOREIGN PATENT DOCUMENTS

CN 104183212 A 12/2014

*Primary Examiner* — Roy P Rabindranath
(74) *Attorney, Agent, or Firm* — Anova Law Group, PLLC

(57) ABSTRACT

A display panel and a display panel compensation method are provided. The display panel comprises at least one pixel compensation circuit including a voltage adjustment module, a conversion module, a first memory module, and a comparison module; and a plurality of pixel driving circuits each including a data input module, a driving module, a second memory module, a sensing module, and a light-emitting element. The pixel compensation circuit compensates a threshold voltage shift of the pixel driving circuit. The voltage adjustment module has an input terminal connected to a first power supply, and an output terminal connected to an input terminal of the data input module. The data input module has an output terminal connected to a controlling terminal of the driving module, and a controlling terminal connected to a first scanning signal line. The driving module has an output terminal connected to an input terminal of the sensing module.

20 Claims, 8 Drawing Sheets

(51) Int. Cl.
*G09G 3/20* (2006.01)
*G09G 3/00* (2006.01)

(58) Field of Classification Search
USPC ..... 345/76–78
See application file for complete search history.

(56) References Cited

U.S. PATENT DOCUMENTS

2008/0266216 A1* 10/2008 Choi ..... G09G 3/3258 345/77
2014/0347253 A1* 11/2014 Lee ..... H05B 33/0896 345/76
2014/0347403 A1* 11/2014 Song ..... G09G 3/3258 345/690

* cited by examiner

DISPLAY PANEL AND DISPLAY PANEL COMPENSATION METHOD

CROSS-REFERENCES TO RELATED APPLICATIONS

This application claims priority of Chinese Patent Application No. 201610685210.8, filed on Aug. 18, 2016, the entire contents of which are hereby incorporated by reference.

FIELD OF THE INVENTION

The present disclosure generally relates to the field of display technology and, more particularly, relates to a display panel and a display panel compensation method.

BACKGROUND

Organic light-emitting diodes (OLED) display devices are considered to be next-generation display devices, because of their fast response, light weight, and power-saving features, etc.

The pixels constituting an OLED display device generally include OLEDs and pixel driving circuits. The pixel driving circuit includes a driving module for driving the OLED. The driving module often adopts a driving transistor, whose gate electrode is applied with various electrical signals, such that the driving transistor can be controlled to output a driving current to the OLED. Accordingly, the OLED emits light in response to the driving current.

However, various factors, such as the fabrication process, and aging, etc., often result in a threshold Vth shift and a carrier mobility degradation in the driving transistor. Thus, the characteristics or properties of the driving transistor in each pixel driving circuit may vary from pixel to pixel, and an image displayed on the display panel may be non-uniform.

The disclosed display panel and compensation method thereof are directed to solve one or more problems set forth above and other problems.

BRIEF SUMMARY OF THE DISCLOSURE

One aspect of the present disclosure provides a display panel. The display panel comprises at least one pixel compensation circuit including a voltage adjustment module, a conversion module, a first memory module, and a comparison module. The display panel also comprises a plurality of pixel driving circuits, wherein a pixel driving circuit includes a data input module, a driving module, a second memory module, a sensing module, and a light-emitting element. The pixel driving circuit is configured to drive the light-emitting element, and the pixel compensation circuit is configured to compensate a threshold voltage shift of the pixel driving circuit. The voltage adjustment module has an input terminal connected to a first power supply, and an output terminal connected to an input terminal of the data input module. The data input module has an output terminal connected to a controlling terminal of the driving module, and a controlling terminal connected to a first scanning signal line. The driving module has an output terminal connected to an input terminal of the sensing module. The sensing module has a controlling terminal connected to the first scanning signal line, and an output terminal connected to an input terminal of the conversion module. The conversion module has an output terminal connected to a first input terminal of the comparison module.

Another aspect of the present disclosure provides a compensation method for a display panel comprising at least one pixel compensation circuit including a voltage adjustment module, a conversion module, a first memory module, and a comparison module; and a plurality of pixel driving circuits, wherein a pixel driving circuit includes a data input module, a driving module, a second memory module, a sensing module, and a light-emitting element, wherein the pixel driving circuit is configured to drive the light-emitting element, and the pixel compensation circuit is configured to compensate a threshold voltage shift of the pixel driving circuit; the voltage adjustment module has an input terminal connected to a first power supply, an output terminal connected to an input terminal of the data input module, and a controlling terminal connected to an output terminal of the comparison module; the data input module has an output terminal connected to a controlling terminal of the driving module, and a controlling terminal connected to a first scanning signal line; the second memory module has a first terminal connected to a controlling terminal of the driving module, and a second terminal connected to an input terminal of the driving module; the driving module has an output terminal connected to an input terminal of the sensing module; the sensing module has a controlling terminal connected to the first scanning signal line, and an output terminal connected to an input terminal of the conversion module; the conversion module has an output terminal connected to a first input terminal of the comparison module; the comparison module has a second input terminal connected to the first memory module; and the light-emitting element has an anode connected to the output terminal of the driving module, and a cathode connected to a second power supply, wherein the compensation method comprises:

turning on the voltage adjustment module; outputting a driving voltage, by the turned-on voltage adjustment module, to the input terminal of the data input module;

controlled by the first scanning signal line, turning on the data input module and the sensing module;

transferring the driving voltage to the controlling terminal of the driving module through the turned-on data input module, and turning on the driving module;

transferring a current flowing through the driving module to the input terminal of the conversion module through the turned-on sensing module;

converting the current transferred to the input terminal of the conversion module, by the conversion module, to a sensing voltage; and comparing the sensing voltage to a target gray-scale voltage of a target gray-scale i stored in the first memory module, by the comparison module, thereby controlling an output of the driving voltage from the output terminal of the voltage adjustment module.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention. Further, in the present disclosure, the disclosed embodiments and the features of the disclosed embodiments may be combined under conditions without conflicts.

The present invention provides an improved display panel, which may be able to compensate the threshold voltage shift in the real time and, thus, eliminate the display non-uniformity caused by the threshold voltage shift.

Figure 1:
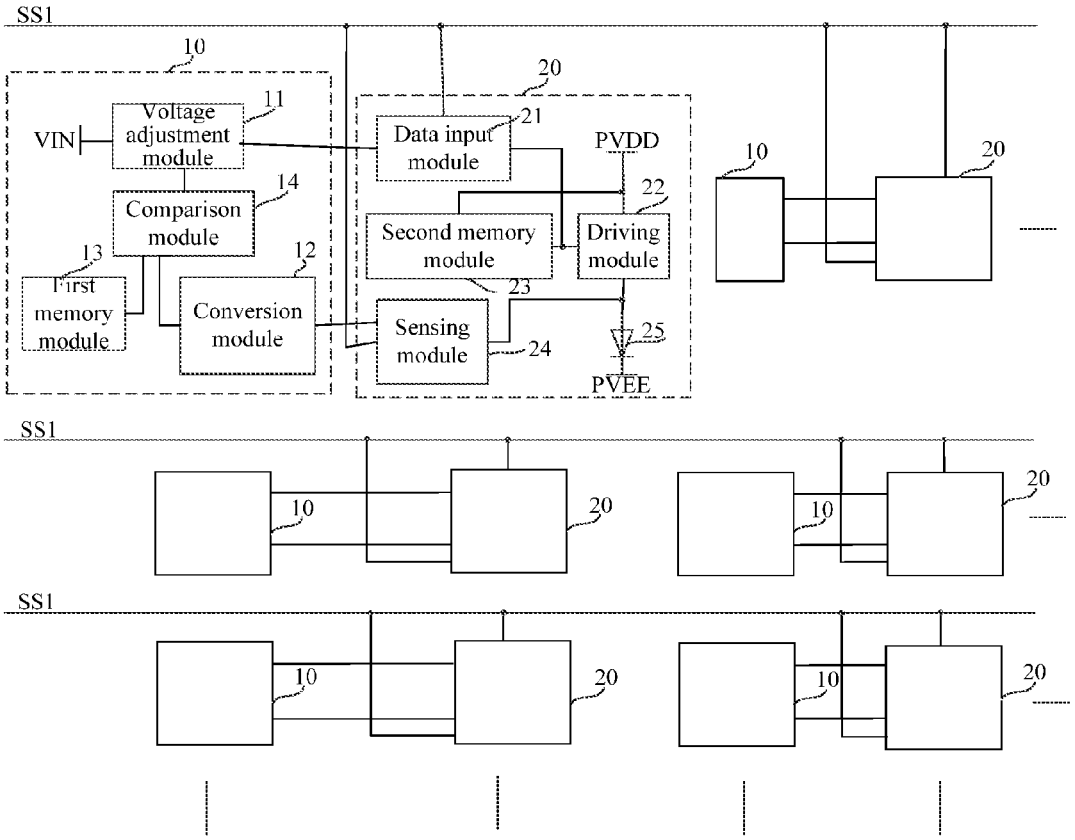
FIG. 1 illustrates a schematic view of an exemplary display panel consistent with disclosed embodiments.

FIG. 1 illustrates a schematic view of an exemplary display panel consistent with disclosed embodiments. As shown in FIG. 1, the display panel may comprise at least one pixel compensation circuit 10 and a plurality of pixel driving circuits 20. In particular, the pixel compensation circuit 10 may include a voltage adjustment module 11, a conversion module 12, a first memory module 13, and a comparison module 14. On the other hand, the pixel driving circuit 20 may include a data input module 21, a driving module 22, a second memory module 23, a sensing module 24, and a display element 25. Other appropriate modules may also be included.

The pixel driving circuit 20 may be configured to drive the display element 25, and the pixel compensation circuit 10 may be configured to compensate the threshold voltage shift of the pixel driving circuit 20. The display element 25 may be a liquid crystal display (LCD) element, an organic light-emitting diode (OLED) display element, a plasma display element, a field emission display (FED) panel, a light-emitting diode (LED) display element, a quantum dots (QDs) display element, an electrophoretic display element or other appropriate display element capable of displaying videos and/or images.

In one embodiment, as shown in FIG. 1, the display element 25 may be a light-emitting element, such as an organic light-emitting diode (OLED) display element, a light-emitting diode (LED) display element, etc. The display element 25 is called as a light-emitting element 25 in the following description.

Further, the voltage adjustment module 11 may have an input terminal connected to a first power supply VIN, an output terminal connected to an input terminal of the data input module 21, and a controlling terminal connected to an output terminal of the comparison module 14. The data input module 21 may have an output terminal connected to a controlling terminal of the driving module 22, a controlling terminal connected to a first scanning signal line SS1. The second memory module 23 may have a first terminal connected to a controlling terminal of the driving module 22, and a second terminal connected to an input terminal of the driving module 22.

The driving module 22 may have an input terminal connected to an output terminal of the sensing module 24. The sensing module 24 may have a controlling terminal connected to the first scanning signal line SS1, and an output terminal connected to an input terminal of the conversion module 12. The conversion module 12 may have an output terminal connected to a first input terminal of the comparison module 14. The comparison module 14 may have a second input terminal connected to the first memory module 13. The light-emitting element 25 may have an anode connected to the output terminal of the driving module 22, and a cathode connected to a second power supply PVEE. The driving module 22 may have the input terminal connected to a fourth power supply PVDD.

The display panel shown in FIG. 1 comprises one pixel compensation circuit 10 and one pixel driving circuit 20, which is for illustrative purposes, and is not intended to limit the number of the pixel compensation circuits, the number of the pixel driving circuits, and the connections among the various pixel compensation circuits and the pixel driving circuits. In another embodiment, the display panel may comprise a plurality of pixel compensation circuits and a plurality of pixel driving circuits, and the pixel compensation circuits may be one-to-one corresponding to the pixel driving circuits, or one pixel compensation circuit may be corresponding to a plurality of pixel driving circuits. The pixel compensation circuit may be configured to compensate the threshold voltage shift in the corresponding pixel driving circuits.

The present disclosure also provides a compensation method for the disclosed display panel, and the disclosed compensation method may be able to compensate the disclosed display panel. An appropriate target gray-scale i may correspond to the emission luminance of the light-emitting element and, meanwhile, may be determined by the current flowing through the light-emitting element. That is, an appropriate target gray-scale i may be determined by the value of the current flowing through the driving module when the driving module is turned on.

In the disclosed embodiments, for an appropriate target gray-scale i, the current flowing through the driving module may be collected, then the current may be converted to a sensing voltage, and the sensing voltage may be compared with the target gray-scale voltage corresponding to the target gray-scale i. The target gray-scale voltage may be a gray-scale voltage required for the normal display of the target gray-scale i.

Figure 8:
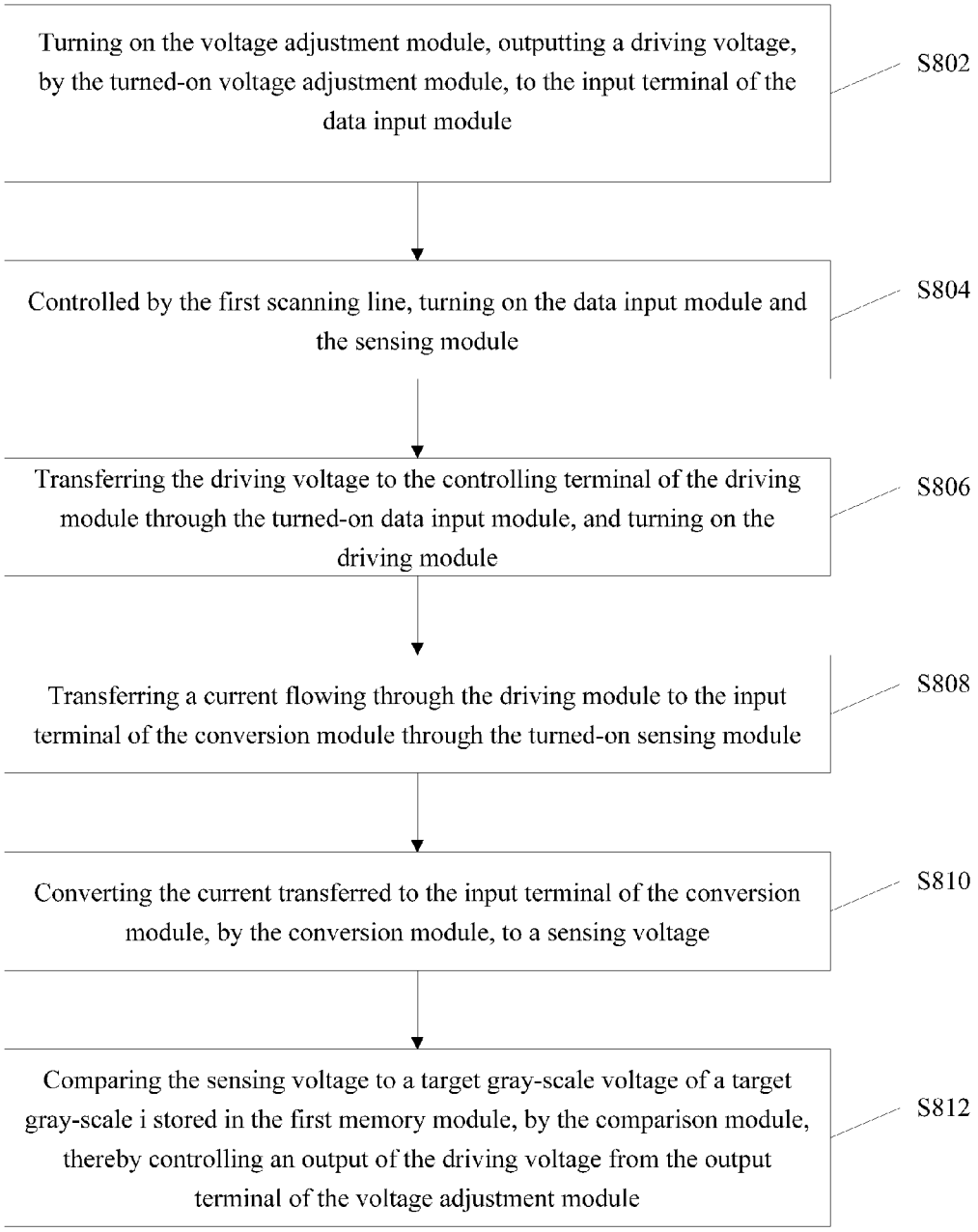
FIG. 8 illustrates a flow chart of an exemplary display panel compensation method consistent with disclosed embodiments.

FIG. 8 illustrates a flow chart of an exemplary display panel compensation method consistent with disclosed embodiments. The display panel compensation method in FIG. 8 may be applicable to the display panel in FIG. 1.

As shown in FIG. 8, at the beginning, the voltage adjustment module 11 may be turned-on, and the turned-on voltage adjustment module outputs a driving voltage to the input terminal of the data input module (S802). In particular, referring to FIG. 1, the voltage adjustment module 11 may be turned-on, and the turned-on voltage adjustment module 11 may output a driving voltage to the input terminal of the data input module 21.

Returning to FIG. 8, after the driving voltage is outputted to the input terminal of the data input module, controlled by the first scanning signal line, the data input module and the sensing module are respectively turned on (S804). In particular, referring to FIG. 1, controlled by the first scanning signal line SS1, the data input module 21 and the sensing module 24 may be turned on.

Returning to FIG. 8, after the data input module and the sensing module are respectively turned on, the driving voltage is transferred to the controlling terminal of the driving module through the turned-on data input module, then the driving module is turned on (S806). In particular, referring to FIG. 1, the driving voltage may be transferred to the controlling terminal of the driving module 22 through the turned-on data input module 21, such that the driving module 22 may be turned on.

Returning to FIG. 8, after the driving module is turned on by the driving voltage, the current flowing through the driving module is transferred to the input terminal of the conversion module through the turned-on sensing module (S808). In particular, referring to FIG. 1, the current flowing through the driving module 22 may be transferred to the input terminal of the conversion module 12 through the turned-on sensing module 24.

Returning to FIG. 8, after the current flowing through the driving module is transferred to the input terminal of the conversion module through the turned-on sensing module, the conversion module converts the current, which is transferred to the input terminal thereof, to a sensing voltage (S810). In particular, referring to FIG. 1, the conversion module 12 may convert the current transferred to the input terminal of the conversion module 12 to a sensing voltage.

Returning to FIG. 8, after the conversion module converts the current transferred to the input terminal of the conversion module to the sensing voltage, the comparison module compares the sensing voltage with the target gray-scale voltage of the target gray-scale i stored in the first memory module and, thus, control the output of the driving voltage from the output terminal of the voltage adjustment module (S812). In particular, referring to FIG. 1, the comparison module 14 may compare the sensing voltage with the target gray-scale voltage of the target gray-scale i stored in the first memory module 13 and, thus, control the output of the driving voltage from the output terminal of the voltage adjustment module 11.

In the disclosed display panel and the disclosed display panel compensation method, the first power supply VIN, which may be electrically connected to the voltage adjustment module 11, may provide a pulse voltage to the voltage adjustment module 11. In particular, the first power supply VIN may be an internal power supply or an external power supply of the display panel.

According to the pulse voltage inputted to the input terminal thereof, the voltage adjustment module 11 may output the driving voltage, whose amplitude and/or phase may be continuously adjusted. Then the driving voltage may be outputted to the input terminal of the data input module 21.

The first scanning signal line SS1 may output a scanning signal, which may control the data input module 21 and the sensing module 24 to be turned on and turned off Under the control of the first scanning signal line SS1, the first scanning signal line SS1 may output a scanning signal, which may drive the data input module 21 and the sensing module 24 to be turned on, and then the data input module 21 and the sensing module 24 may be turned on. The driving voltage may be transferred to the controlling terminal of the driving module 22 through the turned-on data input module 21, such that the driving module 22 may be turned on.

The driving module 22 may include a driving transistor, whose gate electrode may be used as the controlling terminal of the driving module 22. After the driving module 22 is turned on, the current flowing through the driving module 22 may be transferred to the input terminal of the conversion module 12 through the turned-on sensing module 24.

The conversion module 12 may convert the current, which is transferred to the input terminal thereof, to the sensing voltage. Then the sensing voltage may be transferred to the first input terminal of the comparison module 14. The target gray-scale voltage of the target gray-scale i, which is stored in the first memory module 13, may be input to the second input terminal of the comparison module 14.

The comparison module 14 may compare the sensing voltage with the target gray-scale voltage of the target gray-scale i stored in the first memory module 13, and output a corresponding control signal. The control signal may control the output of the driving voltage from the output terminal of the voltage adjustment module 11.

Further, when the sensing voltage outputted from the sensing module 24 is equal to the target gray-scale voltage of the target gray-scale i stored in the first memory module 13, the control signal outputted from the output terminal of the comparison module 14 may control the voltage adjustment module 11 to be turned off. When the voltage adjustment module 11 is turned off, the voltage adjustment module 11 may not output the driving voltage.

When the sensing voltage outputted from the sensing module 24 is different from the target gray-scale voltage of the target gray-scale i stored in the first memory module 13, the control signal outputted from the output terminal of the comparison module 14 may control the voltage adjustment module 11 to be turned on. When the voltage adjustment module 11 is turned on, the voltage adjustment module 11 may output the driving voltage, whose amplitude and/or phase may be continuously adjusted.

In the disclosed embodiments, the voltage adjustment module 11, the data input module 21, the driving module 22, the sensing module 24, the conversion module 12, and the comparison module 14 may form a closed-loop feedback. Even there is a threshold voltage drift and/or a carrier mobility change in the driving transistor, which changes the correspondence relationship between the current flowing through the driving transistor and the driving voltage, the threshold voltage drift and the carrier mobility change in the driving module 22 including the driving transistor may be effectively compensated.

That is, for the target gray-scale i, the current flowing through the driving transistor may be collected by the sensing module 24, the current may be converted by the conversion module 12 into the sensing voltage, until the comparison module 14 determines that the sensing voltage is equal to the target gray-scale voltage of the target gray-scale i and the voltage outputted by the voltage adjustment module 11 is equal to the target gray-scale voltage of the target gray-scale i. In particular, the target gray-scale voltage corresponding to the i-th gray-scale may be the gray-scale voltage required for the normal display of the i-th gray-scale when the drive module 22 does not have any threshold shift.

Thus, the threshold voltage drift and the carrier mobility change in the driving module 22 including the driving transistor may be effectively compensated. Accordingly, the display non-uniformity caused by the threshold voltage drift and/or the carrier mobility change may be eliminated, and the display performance of the display panel may be enhanced.

Figure 2:
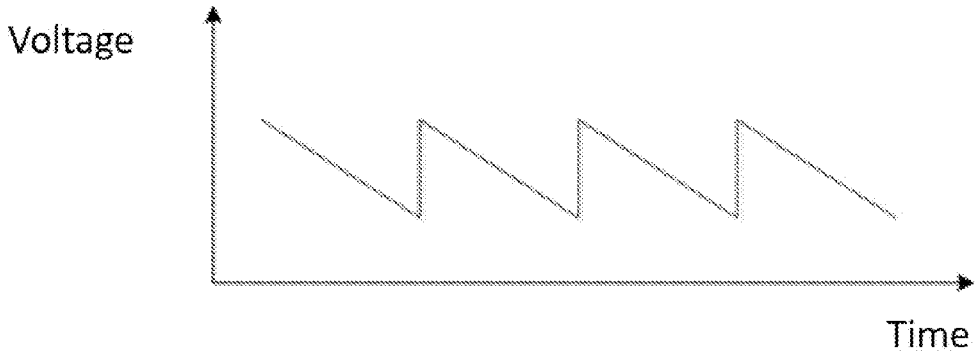
FIG. 2 illustrates an exemplary waveform of a driving voltage outputted by an exemplary voltage adjustment module consistent with disclosed embodiments.
Figure 3:
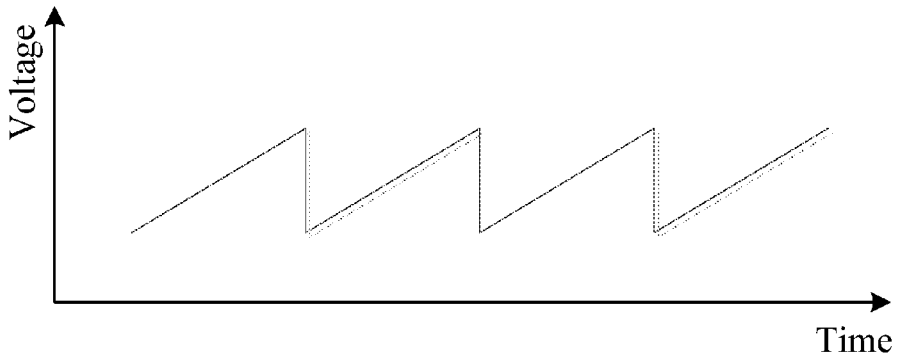
FIG. 3 illustrates another exemplary waveform of a driving voltage outputted by an exemplary voltage adjustment module consistent with disclosed embodiments.

In the disclosed embodiments, the driving voltage outputted by the voltage adjustment module 11 may be a voltage signal which is continuously increased or continuously decreased. Certain examples are illustrated in FIGS. 2-3. FIG. 2 illustrates an exemplary waveform of a driving voltage outputted by an exemplary voltage adjustment module consistent with disclosed embodiments. FIG. 3 illustrates another exemplary waveform of a driving voltage outputted by an exemplary voltage adjustment module consistent with disclosed embodiments.

As shown in FIG. 2, the driving voltage outputted from the voltage adjustment module 11 may be a voltage signal which is periodically and continuously decreased. As shown in FIG. 3, the driving voltage outputted from the voltage adjustment module 11 may be a voltage signal which is continuously and continuously increased. The driving voltage outputted from the voltage adjustment module 11 may also have other waveforms. The waveforms shown in FIGS. 2-3 are for illustrative purposes and are not intended to limit the scope of the present disclosure.

In the disclosed embodiments, the first memory module 13 may store the i-th gray-scale and the corresponding target gray-scale voltage, where $0 \leq i \leq 255$, and i is an integer. The first memory module 13 may include one or more memory, such as random-access RAM, read-only memory, or hybrid memory between random-access and read-only memory.

That is, the memory may store a number of 255 gray-scales and the corresponding target gray-scale voltages of each gray-scale. When the light-emitting element 25 is going to display the i-th gray scale, in a compensation stage, the target gray-scale voltage corresponding to the i-th gray-scale stored in the first memory module 13 may be output to the second input terminal of the comparison module 14. In particular, the target gray-scale voltage corresponding to the i-th gray-scale may be the gray-scale voltage required for the normal display of the i-th gray-scale when the drive module 22 does not have any threshold shift.

The corresponding relationship between the pixel compensation circuits 10 and the pixel driving circuits 20 may vary according to various application scenarios. In one embodiment, as shown in FIG. 1, the plurality of pixel compensation circuits 10 may be one-to-one corresponding to the plurality of pixel driving circuits 20, i.e., one pixel compensation circuit 10 may correspond to one pixel driving circuit 20.

Figure 4:
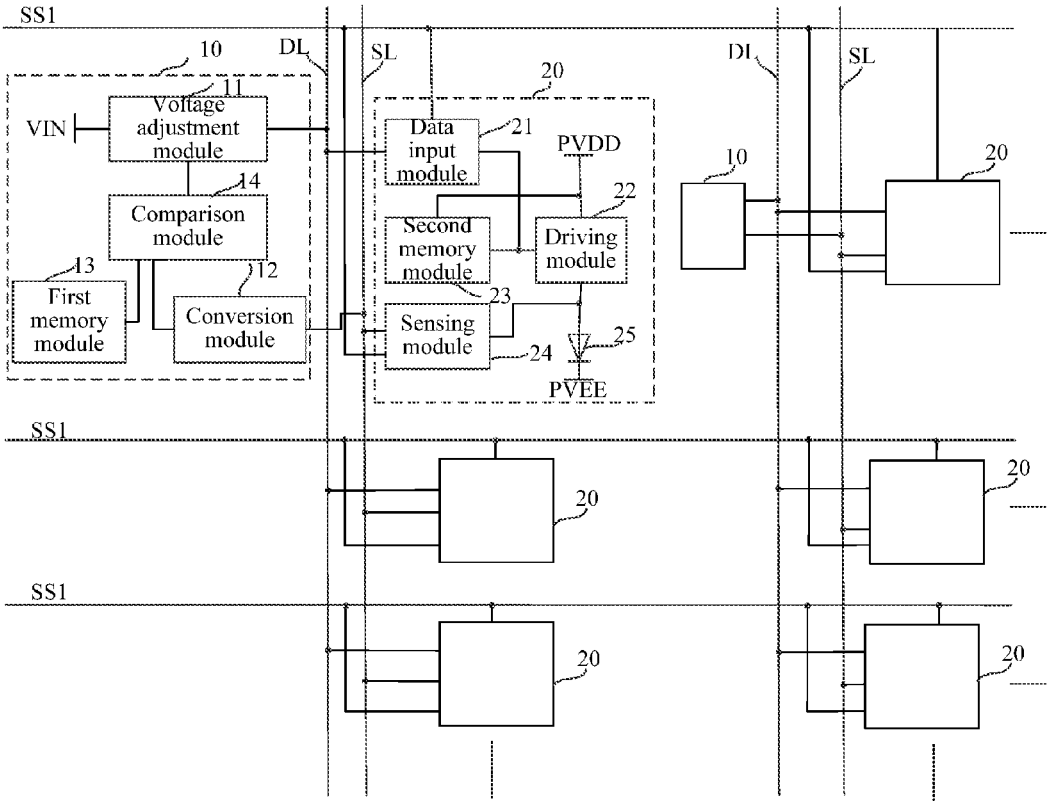
FIG. 4 illustrates a schematic view of another exemplary display panel consistent with disclosed embodiments.

In another embodiment, one pixel compensation circuit 10 may be corresponding to a plurality of pixel driving circuits 20, and an example is illustrated in FIG. 4. FIG. 4 illustrates a schematic view of another exemplary display panel consistent with disclosed embodiments. The similarities between FIG. 4 and FIG. 1 are not repeated here, while certain differences may be explained.

As shown in FIG. 4, the output terminal of the voltage adjustment module 11 may be connected to the input terminal of the data input module 21 through a data line DL. The output terminal of the sensing module 24 may be connected to the input terminal of the conversion module 12 through a sensing line SL. That is, the output terminal of the voltage adjusting module 11 and the input terminal of the data input module 21 may be respectively connected to the data line DL, while the output terminal of the sensing module 24 and the input terminal of the conversion module 12 may be respectively connected to the sensing line SL. Accordingly, the data may be inputted into the data input module 21 through the data line DL. The current, which is to be converted to the sensing voltage by the conversion module 12, may be inputted to the conversion module 12 by the sensing line SL.

Further, the voltage adjustment module 11 in one pixel compensation circuit 10 may be connected to each data input module 21 in the plurality of pixel driving circuits 20 via the data line DL. Meanwhile, each sensing module 24 of the plurality of pixel driving circuits 20 may be connected to the conversion module 12 in the pixel compensation circuit 10 through the sensing line SL.

In one embodiment, the plurality of pixel driving circuits 20 disposed in the same column may be provided with one data line DL and one corresponding sensing line SL. The data input modules 21 in the pixel driving circuits 20 arranged in the same column may be connected to the voltage adjustment module 11 in the pixel compensating circuit 10 through the data line DL. Meanwhile, the sensing modules 24 in the plurality of pixel driving circuits 20 arranged in the same column may be connected to the conversion module 12 in the pixel driving circuit 10 through the sensing line SL.

Figure 5:
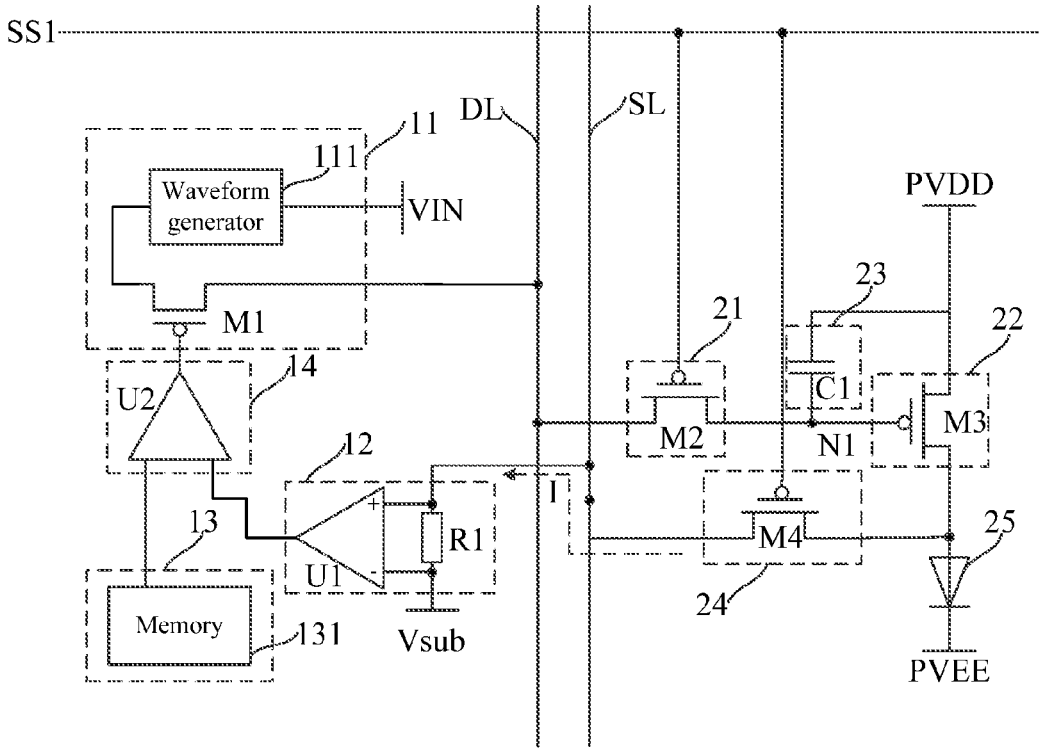
FIG. 5 illustrates a partially enlarged view of another exemplary display panel in FIG. 4 consistent with disclosed embodiments.

FIG. 5 illustrates a partially enlarged view of another exemplary display panel in FIG. 4 consistent with disclosed embodiments. As shown in FIG. 5, the voltage adjustment module 11 may include a waveform generator 111 and a first transistor M1. The conversion module 12 may include a first resistor R1 and an operational amplifier U1. The comparison module 14 may include a comparator U2. The first memory module 13 may include a memory 131. The data input module 21 may include a second transistor M2, the driving module 22 may include a third transistor M3, the sensing module 24 may include a fourth transistor M4, and the second memory module 23 may include a first capacitor C1.

An input terminal of the waveform generator 111 may be connected to the first power supply VIN, and an output terminal of the waveform generator 111 may be connected to a first electrode of the first transistor M1. A gate electrode of the first transistor M1 may be electrically connected to an output terminal of the comparator U2. A second electrode of the first transistor M1 may be connected to a first electrode of the second transistor M2 through the data line DL.

A gate electrode of the second transistor M2 may be connected to the first scanning signal line SS1, and a second electrode of the second transistor M2 may be connected to a gate electrode of the third transistor M3. A third electrode of the third transistor M3 may be connected to a first terminal of the first capacitor C1, and a second electrode of the third transistor M3 may be connected to a first electrode of the fourth transistor M4. A second terminal of the first capacitor C1 may be connected to a gate electrode of the third transistor M3.

A gate electrode of the fourth transistor M4 may be connected to the first scanning signal line SS1. A second electrode of the fourth transistor M4 may be connected to a first terminal of the first resistor R1 through the sense line SL. A second terminal of the first resistor R1 may be connected to a third power supply Vsub.

A first input terminal of the operational amplifier U1 may be connected to the first terminal of the first resistor R1, and a second input terminal of the operational amplifier U1 may be connected to the second terminal of the first resistor R1. An output terminal of the operational amplifier U1 may be connected to a first input terminal of the comparator U2, and a second input terminal of the comparator U2 may be connected to the memory 131. The first electrode of the third transistor M3 may be connected to the fourth power supply PVDD.

In particular, the first scanning signal line SS1 may output a scanning signal to control the second transistor M2 and the fourth transistor M4 to be turned on and turned off. In the disclosed embodiments, the second power supply PVEE may provide a voltage higher than the third power supply Vsub.

In the disclosed embodiments, the driving voltage outputted from the voltage adjustment module 11 may be a continuously increased or continuously decreased. When the voltage adjustment module 11 includes the waveform generator, the waveform outputted by the waveform generator may be a continuously increasing or continuously decreasing waveform. In particular, in the disclosed embodiments, the waveform generator may be a triangular wave generator or a sine wave generator, and the waveform generator may output a triangular wave or a sine wave. That is, the waveform generator may convert the pulse voltage provided by the first power supply VIN to the triangular wave or the sine wave. In another embodiment, the waveform generator may output a wave in other waveforms.

In the disclosed embodiments, the main function of the memory may be to store data, for example, store the i-th gray-scale and its corresponding target gray-scale voltage, where $0 \leq i \leq 255$ and i being an integer. In particular, the target gray-scale voltage corresponding to the i-th gray-scale may be the gray-scale voltage required for the normal display of the i-th gray-scale when the drive module 22 does not have any threshold shift. During an operation of the display panel, memory may be able to store and read the data high speedily and automatically. The memory may include random-access RAM, read-only memory, or hybrid memory between random-access and read-only memory.

In one embodiment, for example, in FIG. 5, the waveform generator 111 may be a triangular wave generator, and the light-emitting element 25 may be an OLED. In another embodiment, the waveform generator 111 may be a wave generator different from the triangular wave generator, and the light-emitting element 25 may be a light-emitting element different from the OLED.

Figure 6:
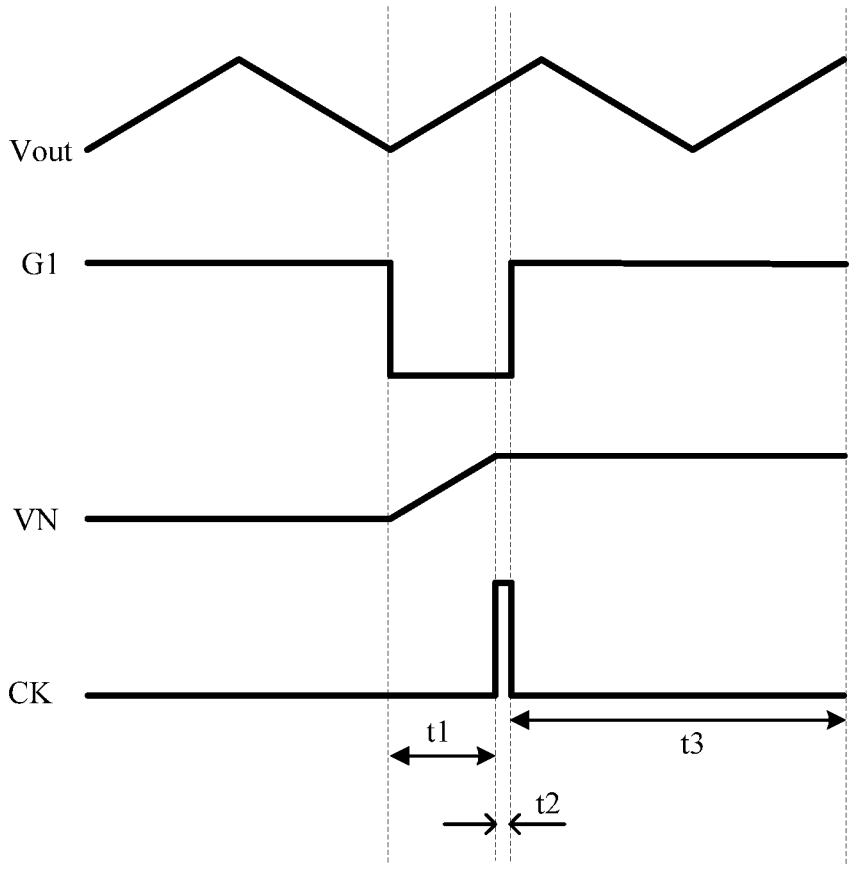
FIG. 6 illustrates an exemplary driving scheme of an exemplary display panel consistent with disclosed embodiments.

FIG. 6 illustrates an exemplary driving scheme of an exemplary display panel consistent with disclosed embodiments, which may be used as a driving scheme for the display panel in FIG. 5. It should be noted that, FIG. 6 illustrates an exemplary driving scheme, which may be applicable to the display panel in FIG. 5 where the first transistor M1 to the fourth transistor M4 are all P-type transistors.

However, in another embodiment, the first transistor M1 to the fourth transistor M4 each may be a N-type transistor. When the first transistor M1 to the fourth transistor M4 each is an N-type transistor, the rising edge of G1 and CK in the driving scheme in FIG. 6 may be changed to be the falling edge.

The operation of the display panel in FIG. 5 will be exemplarily explained in conjunction with the drive scheme in FIG. 6. Referring to FIG. 5 and FIG. 6, Vout denotes a driving voltage signal outputted from the waveform generator, G1 denotes a scanning signal outputted on the first scanning signal line SS1, VN denotes a voltage signal at the first node N1, CK denotes a level signal outputted by the output terminal of the comparator U2.

When the voltage at the first input terminal is equal to the voltage at the second input terminal, the comparator U2 may output a high level signal. When the voltage at the first input terminal is different from the voltage at the second input terminal, the comparator U2 may output a low level signal.

Figure 9:
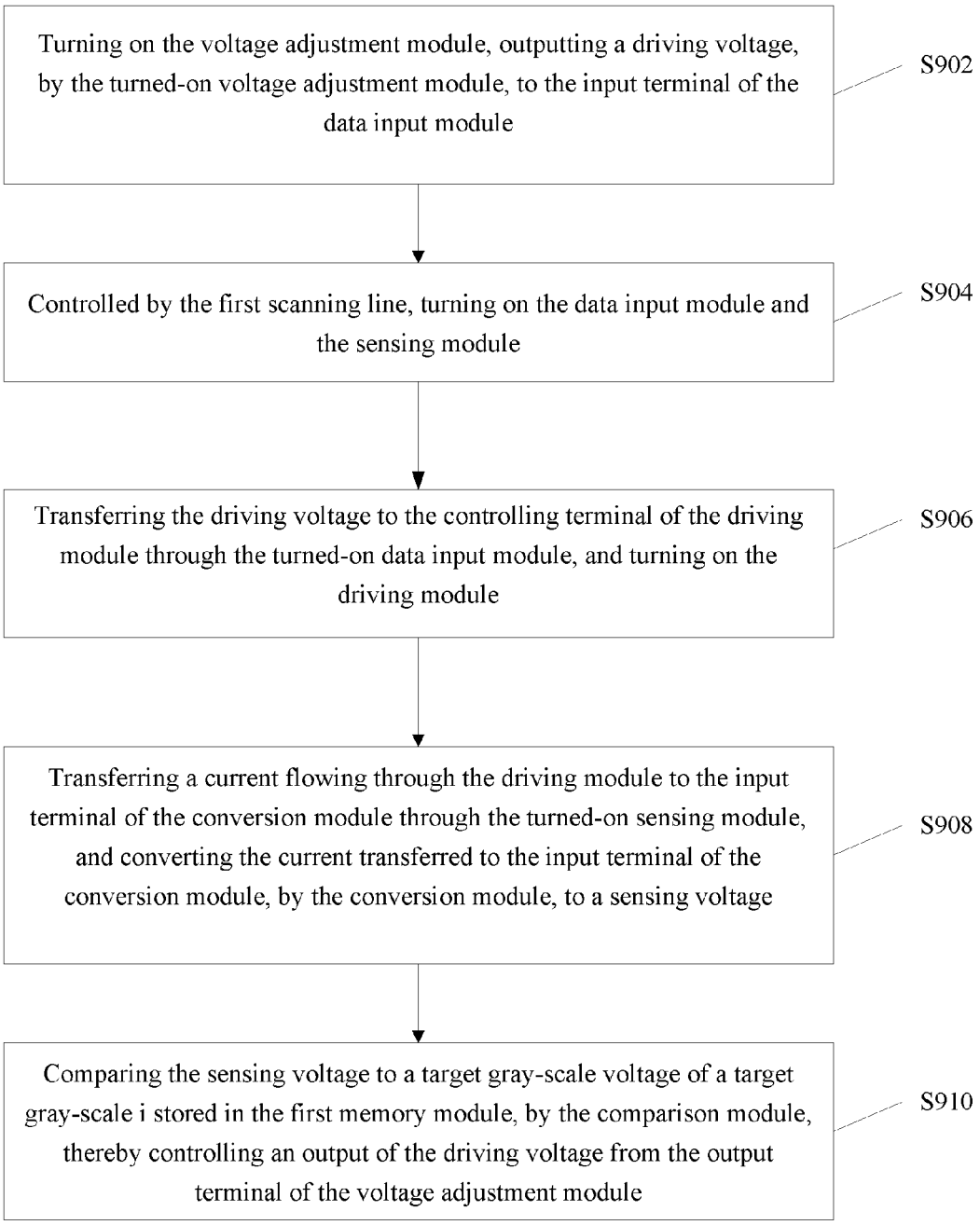
FIG. 9 illustrates a flow chart of another exemplary display panel compensation method consistent with disclosed embodiments.

In particular, the compensation method of the display panel may include compensating the threshold voltage of the third transistor in the display panel in the compensation stage. FIG. 9 illustrates a flow chart of another exemplary display panel compensation method consistent with disclosed embodiments. The display panel compensation method will be explained by the accompany FIGS. 5-6 and FIG. 9.

As shown in FIG. 5 and FIG. 6, t1 denotes the compensation stage, which may include a current detection sub-stage and a comparing sub-stage. During the current detection sub-stage, the current, which is going to be transmitted to the input terminal of the conversion module 12, may be detected. During the comparing sub-stage, the sensing voltage converted from the current by the conversion module 12 may be compared to the target gray-scale voltage of the target gray-scale i.

In particular, as shown in FIG. 9, at the beginning, the voltage adjustment module is turned on, and outputs a driving voltage to the input terminal of the data input module (S902). Referring to FIG. 5 and FIG. 6, the voltage adjustment module 11 may be turned on, which may output a driving voltage to the input terminal of the data input module 21. The voltage adjusting module 11 may include the waveform generator 111, and the data input module 21 may include the second transistor M2.

In particular, before the compensation is not completed, because the voltage at the first input terminal of the comparator U2 is not equal to the voltage at the second input terminal of the comparator U2, the signal CK outputted from the output terminal of the comparator U2 may be a low level signal. Thus, the first transistor M1 may be turned on. The voltage of the first supply VIN may be input to the input terminal of the waveform generator 101, and the driving voltage generated by the waveform generator 111 may be outputted to the first electrode of the second transistor M2.

Returning to FIG. 9, after the voltage adjustment module is turned on, under the control of the first scanning signal line, the data input module and the sensing module are turned on (S904). Referring to FIG. 5 and FIG. 6, under the control of the first scanning signal line SS1, the data input module 21 and the sensing module 24 may be turned on. The sensing module 24 may include the fourth transistor M4. In particular, the scanning signal G1 outputted on the first scanning signal line SS1 may be at a low level, and the second transistor M2 and the fourth transistor M4 may be turned on.

Returning to FIG. 9, after the data input module and the sensing module are turned on, the driving voltage is transmitted to the controlling terminal of the driving module via the turned on data input module, and the driving module is turned on (S906). In particular, referring to FIG. 5 and FIG. 6, the driving voltage may be transmitted to the controlling terminal of the driving module 22 via the turned on data input module 21, and the driving module 22 may be turned on. The driving module 22 may include the third transistor M3.

In particular, the driving voltage generated by the waveform generator 111 may be transferred to the gate electrode of the third transistor M3 via the turned-on second transistor M2, and the driving current I may be generated on the third transistor M3. Because the second power supply PVEE provides a voltage higher than the third power source Vsub, the driving current I may be transferred to the first resistor R1 through the fourth transistor M4, instead of being transferred to the light-emitting element 25. Thus, the light-emitting element 25 may be prevented from emitting light in the compensation stage. The arrow in FIG. 5 denotes the direction of the driving current I.

Returning to FIG. 9, after driving module is turned on, the current flowing through the driving module is transmitted to the input terminal of the conversion module through the turned-on sensing module, and the conversion module converts the current transmitted to the input terminal into the sensing voltage (S908).

Referring to FIG. 5 and FIG. 6, the current flowing through the driving module 11 may be transmitted to the input terminal of the conversion module 12 through the turned-on sensing module 24, and the conversion module 12 may convert the current transmitted to the input terminal into the sensing voltage.

In particular, the drive current I may generates a certain voltage drop across the first resistor R1, and the output terminal of the operational amplifier U1 may output the sensing voltage (i.e., an output voltage generated by amplifying the voltage drop generated by the drive current Ion the first resistor R1). The magnitude of the sensing voltage may be calculated as $V1=K_1*R*I$, where R denotes the resistance of the first resistor R1, and $K_1$ denotes the magnification of operational amplifier U1.

Returning to FIG. 9, after the conversion module converts the current transmitted to the input terminal thereof into the sensing voltage, the comparing module compares the sensing voltage with the target gray-scale voltage of the target gray-scale i stored in the first memory module, thereby controlling the output of the driving voltage at the output terminal of the voltage adjustment module (S910).

Referring to FIG. 5 and FIG. 6, the comparing module 14 may compare the sensing voltage with the target gray-scale voltage of the target gray-scale i stored in the first memory module 13, thereby controlling the output of the driving voltage at the output terminal of the voltage adjustment module 11.

In particular, when the sensing voltage is different from the target gray-scale voltage of the i-th gray-scale, the signal CK outputted from the output terminal of the comparator U2 may be at a low level, and the output terminal of the waveform generator 111 may continue outputting the driving voltage. The voltage VN at the first node N1 (the gate electrode of the third transistor M3) may gradually increase, and the driving current generated by the third transistor M3 may gradually increase.

Because the driving current generated by the third transistor M3 may gradually increase, the sensing voltage V1 may also gradually increase until the sensing voltage V1 is equal to the i-th target gray-scale voltage Vi. When V1=Vi, the signal CK at the output terminal of the comparator U2 may be a high-level signal. When the signal CK at the output terminal of the comparator U2 is a high-level signal, the first transistor M1 may be turned off, and the voltage at the gate electrode of the third transistor M3 may substantially the same.

In particular, in the disclosed embodiments, the driving voltage Vg supplied to the third transistor M3 and the saturation region current Is may satisfy the following relationship $$Is = \frac{1}{2}\mu\frac{W}{L}\mathrm{Cox}(Vgs - Vth)^2 = \frac{1}{2}\mu\frac{W}{L}\mathrm{Cox}(Vg - PVDD - Vth)^2,$$

where W denotes the channel width of the third transistor M3, L denotes the channel length of the third transistor M3, μ denotes the carrier mobility, Cox denotes the capacitance per unit area of the gate oxide layer, Vgs denotes the voltage between the gate electrode and source electrode of the third transistor M3, Vg denotes the driving voltage provided to the gate electrode of the third transistor M3 (i.e., the driving voltage outputted from the voltage adjustment module 11), PVDD denotes the voltage applied to the source electrode of the third transistor, and Vth denotes the threshold voltage of the third transistor M3.

According to the above equation, the saturation region current Is may be not only affected by the carrier mobility μ and the threshold voltage Vth, but also by the driving voltage Vg. When the carrier mobility μ and the threshold voltage Vth vary, through adjusting the driving voltage Vg, the saturation region current Is may substantially remain the same.

For example, in one embodiment, as shown in FIG. 5, when the third transistor M3 has a threshold voltage drift, for the target gray-scale i, through adjusting the driving voltage Vg outputted from the voltage adjustment module 11 of the pixel compensation circuit 10, the current I flowing through the third transistor M3 may be configured to substantially be the same as the saturation region current Is. That is, the threshold voltage drift and the carrier mobility degradation of the third transistor M3 may be compensated and, accordingly, the display non-uniformity caused by the threshold voltage drift and the carrier mobility degradation of the third transistor M3 may be eliminated.

In particular, at the end of the time period t1, the driving voltage outputted from the waveform generator 111 may be stored in the first capacitor C1. Due to the first capacitor C1, the driving voltage provided to the third transistor M3 (i.e., the voltage applied to the first node N1) may substantially remain the same. Accordingly, in the following time period t2, the current I may substantially remain the same as the saturation current Is, the signal CK may keep the high level, and the first transistor M1 may be turned off.

Further, the driving scheme may also include a light-emitting stage t3, which may be provided after the compensation stage. In the light-emitting stage t3, the first scanning signal line SS1 may be configured to output a high level signal, and the second transistor M2 and the fourth transistor M4 may be turned off. The voltage at the first capacitor C1 may be written to the gate electrode and the source electrode of the third transistor M3. Because the voltage at the first node N1 may substantially remain the same, the voltage at the first capacitor C1 may be the same as the voltage obtained at the end of the time period t1 in the compensation stage. The current flowing through the third transistor M3 may be I, and the current I may be unable to be transferred to the first resistor R1 through the fourth transistor M4. Then the driving current I may be transferred to the OLED (i.e., the light-emitting element 25), and the OLED may emit light in response to the driving current I.

Figure 7:
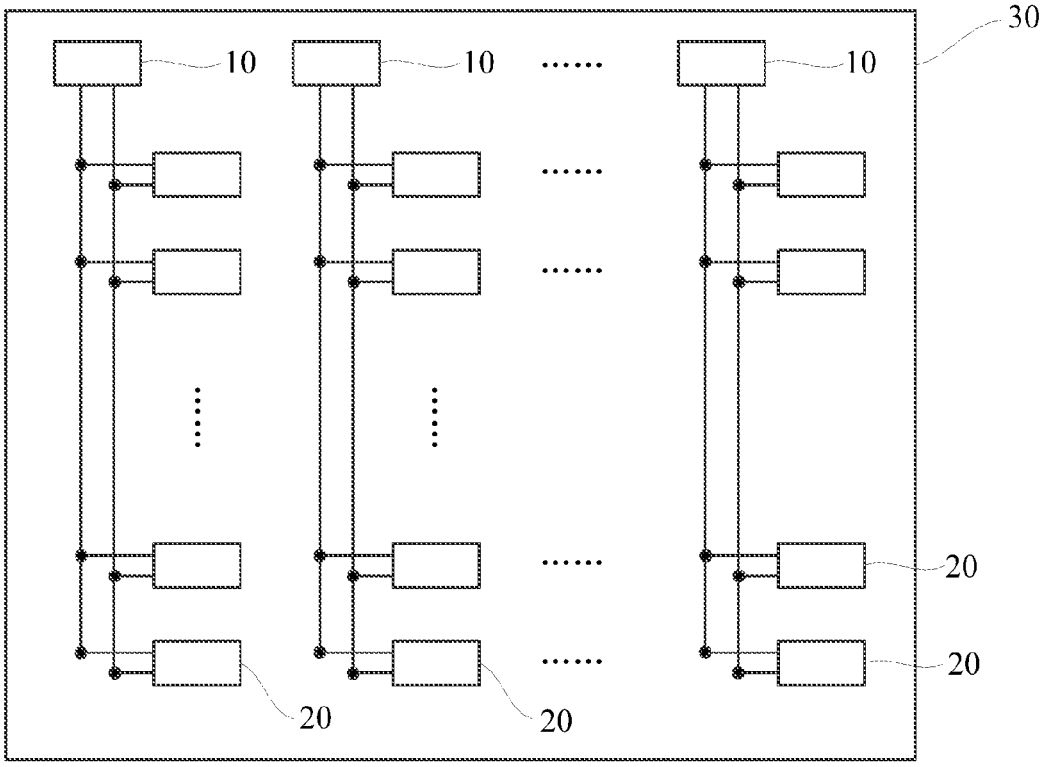
FIG. 7 illustrates a schematic view of another exemplary display panel consistent with disclosed embodiments.

In certain embodiments, a plurality of pixel drive circuits 20 may be corresponding to one pixel compensation circuit 10, for example, a corresponding structure of the display panel is shown in FIG. 7. FIG. 7 illustrates a schematic view of another exemplary display panel consistent with disclosed embodiments. As shown in FIG. 7, the display panel 30 may include a plurality of pixel compensation circuits 10 and a plurality of pixel driving circuits 20. In particular, the pixel driving circuits 20 disposed in the same column may share a same pixel compensation circuit 10.

In the disclosed embodiments, the display panel 30 may include a non-display area and a display area. The pixel compensation circuit 10 may be disposed in the non-display area of the display panel 30, and the pixel driving circuit 20 may be disposed in the display area of the display panel 30. In another embodiment, the pixel compensation circuit may be provided by a driving chip, i.e., the pixel compensation circuit may be integrated into the driving chip, and the driving chip may be disposed in the non-display region of the display panel.

In the disclosed embodiments, the data input module may be configured to transfer the driving voltage outputted from the voltage adjustment module to the controlling terminal of the driving module, the conversion module may be configured to convert the current detected by the sensing module to a sensing voltage, and the comparison module may be configured to compare the sensing voltage with the target gray-scale voltage of the target gray-scale i, thereby controlling the output of the driving voltage from the voltage adjustment module.

That is, the voltage adjustment module, the data input module, the driving module, the sensing module, the conversion module, and the comparison module may form a closed-loop feedback, such that the driving module can output a driving voltage corresponding to the target gray-scale i. Even the driving transistor has a threshold voltage drift and a carrier mobility change, the driving voltage may enable the sensing voltage converted from the current flowing through the driving voltage to be substantially equal to the target gray-scale voltage.

Thus, the threshold voltage drift and the carrier mobility degradation may be compensated. Accordingly, the display non-uniformity caused by the threshold voltage drift or the carrier mobility change may be solved, and the image performance of the display pane may be enhanced. In addition, the pixel compensation circuit and the pixel driving circuit may have a simple structure, which may be highly desired by the high PPI (pixel per inch) display panel. The disclosed display panel and the compensation method thereof may also be applicable to a display panel which is already provided with an external threshold shift compensation.

Those of skill would further appreciate that the various illustrative modules and steps disclosed in the embodiments may be implemented as electronic hardware, computer software, or combinations of both. To clearly illustrate this interchangeability of hardware and software, various illustrative modules and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The steps of a method disclosed in the embodiments may be embodied directly in hardware, in a software unit executed by a processor, or in a combination of the two. A software unit may reside in RAM, flash memory, ROM, EPROM (erasable programmable read-only memory), EEPROM (electrically erasable programmable read-only memory), registers, hard disk, a removable disk, a CD-ROM, or any other form of storage medium known in the art.

The description of the disclosed embodiments is provided to illustrate the present invention to those skilled in the art. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A display panel, comprising:

at least one pixel compensation circuit including a voltage adjustment module, a conversion module, a first memory module, and a comparison module; and a plurality of pixel driving circuits, wherein a pixel driving circuit includes a data input module, a driving module, a second memory module, a sensing module, and a light-emitting element, wherein the pixel driving circuit is configured to drive the light-emitting element, and the pixel compensation circuit is configured to compensate a threshold voltage shift of the pixel driving circuit, the voltage adjustment module has an input terminal connected to a first power supply, and an output terminal connected to an input terminal of the data input module, the data input module has an output terminal connected to a controlling terminal of the driving module, and a controlling terminal connected to a first scanning signal line, the driving module has an output terminal connected to an input terminal of the sensing module, the sensing module has a controlling terminal connected to the first scanning signal line, and an output terminal connected to an input terminal of the conversion module, and the conversion module has an output terminal connected to a first input terminal of the comparison module.

2. The display panel according to claim 1, wherein:

the voltage adjustment module has a controlling terminal connected to an output terminal of the comparison module;

the second memory module has a first terminal connected to a controlling terminal of the driving module, and a second terminal connected to an input terminal of the driving module;

the comparison module has a second input terminal connected to the first memory module; and the light-emitting element has an anode connected to the output terminal of the driving module, and a cathode connected to a second power supply.

3. The display panel according to claim 1, wherein:

the output terminal of the voltage adjustment module is connected to the input terminal of the data input module through a data line; and the output terminal of the sensing module is connected to the input terminal of the conversion module through a sensing line.

4. The display panel according to claim 3, wherein:

the voltage adjustment module includes a waveform generator and a first transistor, the conversion module includes a first resistor and an operational amplifier, the comparison module includes a comparator, the first memory module includes a memory, the data input module includes a second transistor, the driving module includes a third transistor, the sensing module includes a fourth transistor, and the second memory module includes a first capacitor; and an input terminal of the waveform generator is connected to the first power supply, and an output terminal of the waveform generator is connected to a first electrode of the first transistor, a gate electrode of the first transistor is electrically connected to an output terminal of the comparator, and a second electrode of the first transistor is connected to a first electrode of the second transistor through the data line;

a gate electrode of the second transistor is connected to the first scanning signal line, and a second electrode of the second transistor is connected to a gate electrode of the third transistor;

a third electrode of the third transistor is connected to a first terminal of the first capacitor, and a second electrode of the third transistor is connected to a first electrode of the fourth transistor;

a second terminal of the first capacitor is connected to a gate electrode of the third transistor;

a gate electrode of the fourth transistor is connected to the first scanning signal line, and a second electrode of the fourth transistor is connected to a first terminal of the first resistor through the sense line;

a second terminal of the first resistor is connected to a third power supply;

a first input terminal of the operational amplifier is connected to the first terminal of the first resistor, and a second input terminal of the operational amplifier is connected to the second terminal of the first resistor, and an output terminal of the operational amplifier is connected to a first input terminal of the comparator; and a second input terminal of the comparator is connected to the memory.

5. The display panel according to claim 4, wherein:

the first transistor, the second transistor, the third transistor, and the fourth transistor are P-type transistors, respectively.

6. The display panel according to claim 4, wherein:

the waveform generator is a triangular wave generator or a sine wave generator.

7. The display panel according to claim 4, wherein:

the second power supply provides a voltage higher than the third power supply.

8. The display panel according to claim 1, wherein:

the first memory module stores the i-th gray-scale and its corresponding target gray-scale voltage, where $0 \leq i \leq 255$, and i is an integer.

9. The display panel according to claim 8, wherein:

the target gray-scale voltage corresponding to the i-th gray-scale is the gray-scale voltage required for the normal display of the i-th gray-scale when the drive module does not have any threshold shift.

10. The display panel according to claim 1, wherein:

the pixel compensation circuit is one-to-one corresponding to the pixel driving circuit.

11. The display panel according to claim 1, wherein:

the pixel driving circuits disposed in a same column share a same pixel compensation circuit.

12. The display panel according to claim 1, wherein:

the display panel comprises a non-display area and a display area;

the pixel compensation circuit is disposed in the non-display area of the display panel; and the pixel driving circuit is disposed in the display area of the display panel.

13. A compensation method for a display panel comprising at least one pixel compensation circuit including a voltage adjustment module, a conversion module, a first memory module, and a comparison module; and a plurality of pixel driving circuits, wherein a pixel driving circuit includes a data input module, a driving module, a second memory module, a sensing module, and a light-emitting element, wherein the pixel driving circuit is configured to drive the light-emitting element, and the pixel compensation circuit is configured to compensate a threshold voltage shift of the pixel driving circuit; the voltage adjustment module has an input terminal connected to a first power supply, an output terminal connected to an input terminal of the data input module, and a controlling terminal connected to an output terminal of the comparison module; the data input module has an output terminal connected to a controlling terminal of the driving module, and a controlling terminal connected to a first scanning signal line; the second memory module has a first terminal connected to a controlling terminal of the driving module, and a second terminal connected to an input terminal of the driving module; the driving module has an output terminal connected to an input terminal of the sensing module; the sensing module has a controlling terminal connected to the first scanning signal line, and an output terminal connected to an input terminal of the conversion module; the conversion module has an output terminal connected to a first input terminal of the comparison module; the comparison module has a second input terminal connected to the first memory module; and the light-emitting element has an anode connected to the output terminal of the driving module, and a cathode connected to a second power supply, wherein the compensation method comprises:

turning on the voltage adjustment module;

outputting a driving voltage, by the turned-on voltage adjustment module, to the input terminal of the data input module;

controlled by the first scanning signal line, turning on the data input module and the sensing module;

transferring the driving voltage to the controlling terminal of the driving module through the turned-on data input module, and turning on the driving module;

transferring a current flowing through the driving module to the input terminal of the conversion module through the turned-on sensing module;

converting the current transferred to the input terminal of the conversion module, by the conversion module, to a sensing voltage; and comparing the sensing voltage to a target gray-scale voltage of a target gray-scale i stored in the first memory module, by the comparison module, thereby controlling an output of the driving voltage from the output terminal of the voltage adjustment module.

14. The compensation method according to claim 13, wherein:

when the sensing voltage outputted from the sensing module is equal to the target gray-scale voltage of the target gray-scale i stored in the first memory module, a control signal outputted from the output terminal of the comparison module controls the voltage adjustment module to be turned off; and when the sensing voltage outputted from the sensing module is different from the target gray-scale voltage of the target gray-scale i stored in the first memory module, the control signal outputted from the output terminal of the comparison module controls the voltage adjustment module to be turned on.

15. The compensation method according to claim 13, wherein:

the driving voltage outputted by the voltage adjustment module is a continuously increased or continuously decreased voltage signal.

16. The compensation method according to claim 13, wherein:

the target gray-scale voltage stored in the first memory and corresponding to the i-th gray-scale is the gray-scale voltage required for the normal display of the i-th gray-scale when the drive module does not have any threshold shift.

17. The compensation method according to claim 13, wherein:

$0 \leq i \leq 255$, and i is an integer.

18. The compensation method according to claim 13, wherein:

the second power supply provides a voltage higher than the third power supply.

19. The compensation method according to claim 13, wherein:

the waveform generator is a triangular wave generator or a sine wave generator.

20. The compensation method according to claim 13, wherein:

the first transistor, the second transistor, the third transistor, and the fourth transistor are P-type transistors, respectively.

* * * * *